US007474935B2

(12) United States Patent
Fetahovic

(10) Patent No.: US 7,474,935 B2
(45) Date of Patent: Jan. 6, 2009

(54) METHOD AND SYSTEM FOR TRACKING PRODUCT DATA FOR A PRODUCT MASS FLOW IN A TRANSPORT STORAGE SECTION OF THE TOBACCO-PROCESSING INDUSTRY

(75) Inventor: Amir Fetahovic, Oststeinbek (DE)

(73) Assignee: Hauni Maschinenbau AG, Hamburg (DE)

( * ) Notice: Subject to any disclaimer, the term of this patent is extended or adjusted under 35 U.S.C. 154(b) by 535 days.

(21) Appl. No.: 11/115,324

(22) Filed: Apr. 27, 2005

(65) Prior Publication Data

US 2005/0246048 A1 Nov. 3, 2005

(30) Foreign Application Priority Data

Apr. 28, 2004 (DE) ..... 10 2004 021 440

(51) Int. Cl.
*G06F 19/00* (2006.01)

(52) U.S. Cl. ..... 700/115; 700/217; 700/229; 700/236

(58) Field of Classification Search ..... 700/115–117, 700/213–215, 217, 221, 224–226, 228–230, 700/236; 705/22, 28; 235/385; 198/349.5–349.95; 131/280, 282, 283, 907, 909, 910
See application file for complete search history.

(56) References Cited

U.S. PATENT DOCUMENTS 3,672,373 A 6/1972 Dögl et al.
3,726,383 A * 4/1973 Bornfleth et al. ..... 198/358
4,280,187 A 7/1981 Reuland et al.
5,478,184 A * 12/1995 Bryant et al. ..... 414/416.05
5,628,162 A * 5/1997 Kreusch et al. ..... 53/168
5,764,520 A * 6/1998 Robinson et al. ..... 700/115
5,844,802 A * 12/1998 Lepper et al. ..... 700/115
6,549,891 B1 * 4/2003 Rauber et al. ..... 705/28
7,007,841 B2 * 3/2006 Kocott ..... 235/385
7,036,729 B2 * 5/2006 Chung ..... 235/385
7,127,315 B2 * 10/2006 Junge et al. ..... 700/109
2003/0006878 A1 * 1/2003 Chung ..... 340/5.25
2005/0092579 A1 * 5/2005 Spatafora ..... 198/347.1
2005/0166784 A1 * 8/2005 Lehrieder ..... 104/88.03
2006/0180647 A1 * 8/2006 Hansen ..... 235/375

FOREIGN PATENT DOCUMENTS

DE 102 16 069 A1 10/2003
DE 102 16 069 A1 10/2003
EP 0 602 683 A1 6/1994
GB 1 234 776 A 6/1971
WO WO-00/16647 A1 3/2000

* cited by examiner

*Primary Examiner*—M. N. Von Buhr
(74) *Attorney, Agent, or Firm*—Venable LLP; Robert Kinberg; Steven J. Schwarz

(57) ABSTRACT

The application relates to a method for tracking product data for a product mass flow in a transport storage section of the tobacco-processing industry having the steps: production of product data sets which each correspond to approximately equal portions of the product mass flow entering the transport storage section, writing the product data sets into corresponding memory units of a data memory and reading the product data sets corresponding to the product mass flow emerging from the transport storage section from the data memory. The application further relates to a corresponding product dating tracking system.

20 Claims, 3 Drawing Sheets

METHOD AND SYSTEM FOR TRACKING PRODUCT DATA FOR A PRODUCT MASS FLOW IN A TRANSPORT STORAGE SECTION OF THE TOBACCO-PROCESSING INDUSTRY

CROSS-REFERENCE TO RELATED APPLICATION

This application claims the priority of German Patent Application No. 10 2004 021 440.9 filed Apr. 28, 2004, the subject matter of which is incorporated herein by reference. The disclosure of all U.S. and foreign patents and patent applications mentioned below are also incorporated herein by reference.

BACKGROUND OF THE INVENTION

The invention relates to a method and a system for tracking product data, for example quality data, brand information, production machine identification, production time, in a transport storage section of the tobacco-processing industry.

DE 102 16 069 A1 discloses a method and an apparatus for tracking product data for individual products in a machine in the tobacco-processing industry which operates with a certain machine cycle, i.e. processes a certain number of individual products per minute. The assignment of the product data to the individual products is based in this case on precise knowledge of the machine cycle and the length of path covered by the product in the machine. This method cannot be transferred to a product mass flow having numerous unordered individual products such as, for example, in a transport section between a cigarette production machine and a packing machine, since here the assignment of the product data to the individual products gets lost. This problem is aggravated when the length of path in the transport storage section is variable as is the case, for example, when a variable cigarette store is used.

SUMMARY OF THE INVENTION

The object of the invention consists in providing a method and a system for tracking product data for a product mass flow in a transport storage section in the tobacco-processing industry.

The invention solves this object in particular by the following steps and corresponding apparatus characteristics: production of product data sets which each correspond approximately to uniform successive portions of the product mass flow entering the transport storage section, writing the product data sets in corresponding memory units of a data memory and reading the product data sets corresponding to the product mass flow emerging from the transport storage section from the data memory. The invention is based in particular on the virtual apportioning of the product mass flow and the production and storage of product data sets corresponding to the individual portions of product. By means of this subdivision it is possible according to the invention to track product data averaged over a portion of product.

The data memory has a memory input and a memory output, wherein the product data sets are written via the memory input into the memory medium and are stored there in a fixed sequence and the product data sets written into the memory medium in a sequence matching the sequence of the corresponding portions of product in the transport storage section are read out from the memory medium via the output.

The transport storage section is a unit for the automatic transportation and/or storage of the product mass flow. Preferably the data memory maps the transport storage section logically. When, for example, the transport storage section comprises a pure transport section or a FIFO store in which the product mass flow enters at an entrance and exits in the same sequence at an exit the data memory usefully comprises a corresponding FIFO data memory (first in, first out principle). When, for example, the transport storage section comprises a cul-de-sac store into which the product mass flow enters and from which the product mass flow emerges in the reverse sequence the data memory usefully comprises a corresponding FILO or LIFO data memory (first in, last out or last in, first out principle).

A preferred implementation of a FIFO data memory is a ring memory having in each case a displaceable write and read pointer. Preferably, their position is shifted to a logically adjacent memory unit after a product data set has been written or after the emergence of a portion of product from the transport section. Furthermore, the position of the write or read pointer is preferably fixed in the event of a stoppage of the product mass flow entering the transport section or of the product mass flow leaving the transport section.

Another preferred implementation of a FIFO data memory is a FIFO stack memory (FIFO stack). Product data sets for a product mass flow entering the transport section are written to the FIFO stack memory and product data sets for the product mass flow emerging from the transport section are read out of the FIFO stack memory.

A preferred implementation of a FILO data memory is, accordingly, a FILO stack memory (FILO stack).

The invention is not restricted to said implementations of FIFO or FILO data memories. The use of shift registers, for example, is also covered by the invention.

The apportioning is preferably done in segments of uniform length of the product mass flow in the transport direction since this variable is particularly simple to determine from the speed of transport. Other types of apportioning are also conceivable, however, for example in portions having an approximately equal number of individual products or in portions of approximately equal weight.

Preferably the length or more generally the size of the product portions is adjustable in order to allow adaptation to different requirements. Preferably, the product data sets are set up for storing the length of the product portion in the transport direction. This can be useful in particular for transport storage sections having a plurality of transport segments of differing speed since in this case the length of the product portions varies. Preferably, the product data sets are set up for storing a product occupancy designation which specifies whether the transport segment corresponding to the product data set is occupied by product. This can be useful in order to identify a lack of occupation or other type of occupation of transport segments.

In order to identify a product mass stream entering the transport storage section or emerging therefrom the product data tracking system preferably comprises corresponding entry or exit sensors.

In the case of a majority of transport segments or transport devices in the transport section it can be useful to assign a data subset memory to each transport segment or each transport device. Each subset memory can, for example, be a ring memory having a write and read pointer, as described above.

Each subset memory can also be constructed, by way of example, as a FIFO or FILO stack memory.

BRIEF DESCRIPTION OF THE DRAWINGS

Other advantageous characteristics emerge from the subsidiary claims and the following description of advantageous exemplified embodiments with reference to the attached drawings. These show:

DETAILED DESCRIPTION OF THE INVENTION

Figure 1:
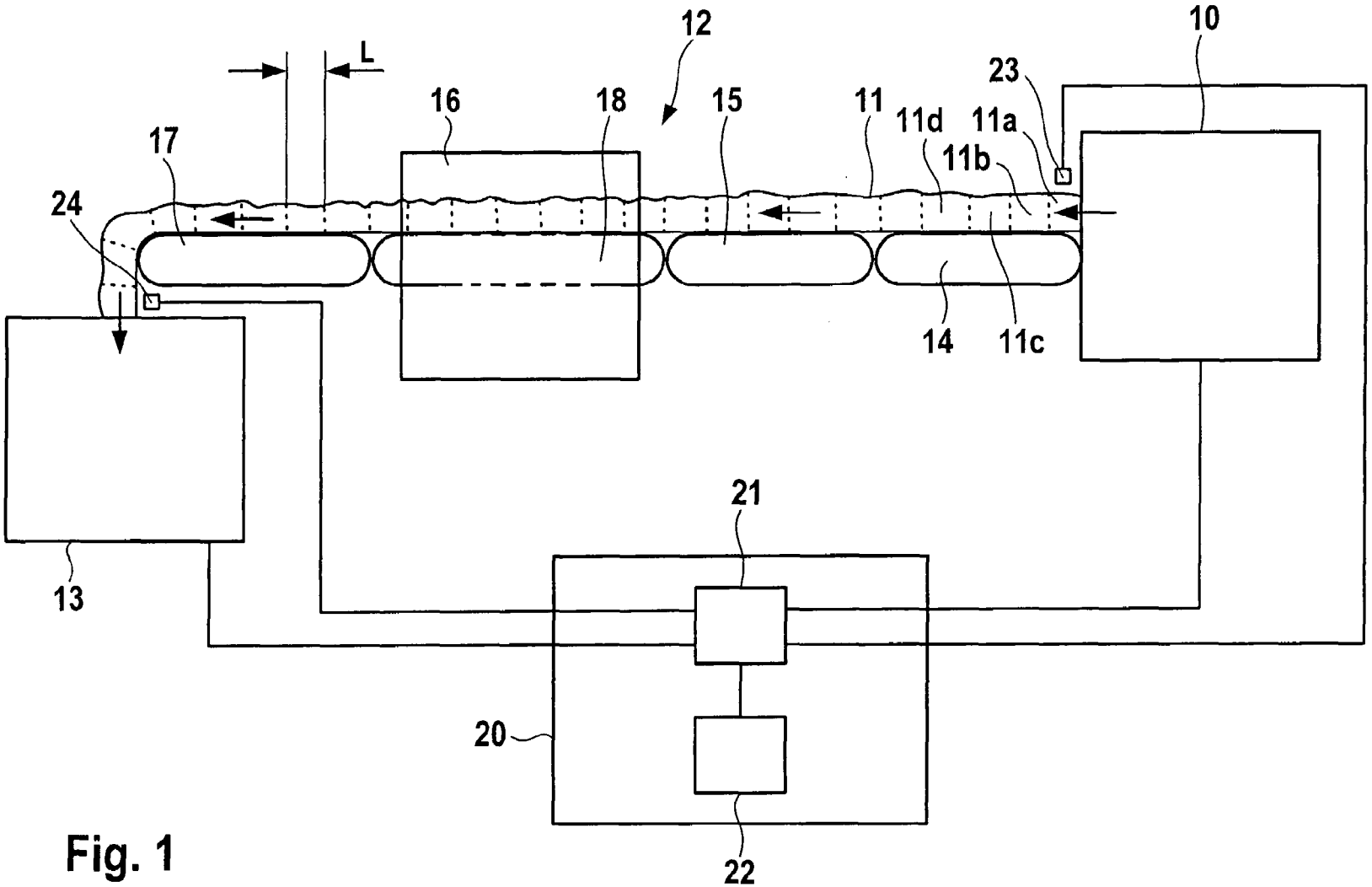
FIG. 1: a schematic overview of a product data tracking system for a transport section between a cigarette production machine and a packing machine.

Cigarettes come out of a cigarette production machine 10 and are conveyed in the form of an unordered stream of cigarettes 11 containing, for example, of the order of 1,000 cigarettes per meter of transport section in the direction of the arrow by means of a transport section 12 to a packing machine 13. The transport section 12 comprises a plurality of transport devices 14-17 which are drawn in the figures purely schematically as conveyor belts but by no means are restricted to these. The transport section 12 comprises inter alia a FIFO cigarette store 16 having a transport device 18 whose length is variable depending on storage demand as indicated in FIG. 1 by means of dotted lines.

In the cigarette production machine 10 product data about the cigarettes produced are present, for example cigarette quality data, brand information, an identification of the production machine 10, date and time of production, etc. The product data tracking system comprises a data processing unit 20 having a control means 21 and a storage means 22. The control means 21 requests production data from the cigarette production machine 10 and periodically writes corresponding production data sets 30*a*, 30*b*, 30*c*, . . . into the storage means 22. By this means the product mass flow 11 is virtually subdivided into product portions 11*a*, 11*b*, 11*c*, . . . as indicated in FIG. 1 by dotted lines. When the transport speed of the stream of cigarettes 11 through the transport section 12 is, by way of example, 20 cm/s and the control means 21 writes production data requested from the cigarette production machine 10 once a second as production data sets 30*a*, 30*b*, 30*c*, . . . into the storage means 22 this corresponds to a virtual apportioning of the product mass flow 12 into product portions 11*a*, 11*b*, 11*c*, . . . of a certain length, in this example a portion length of 20 cm. In doing this, the production data set usefully contains production data averaged over one storage period.

Figure 2:
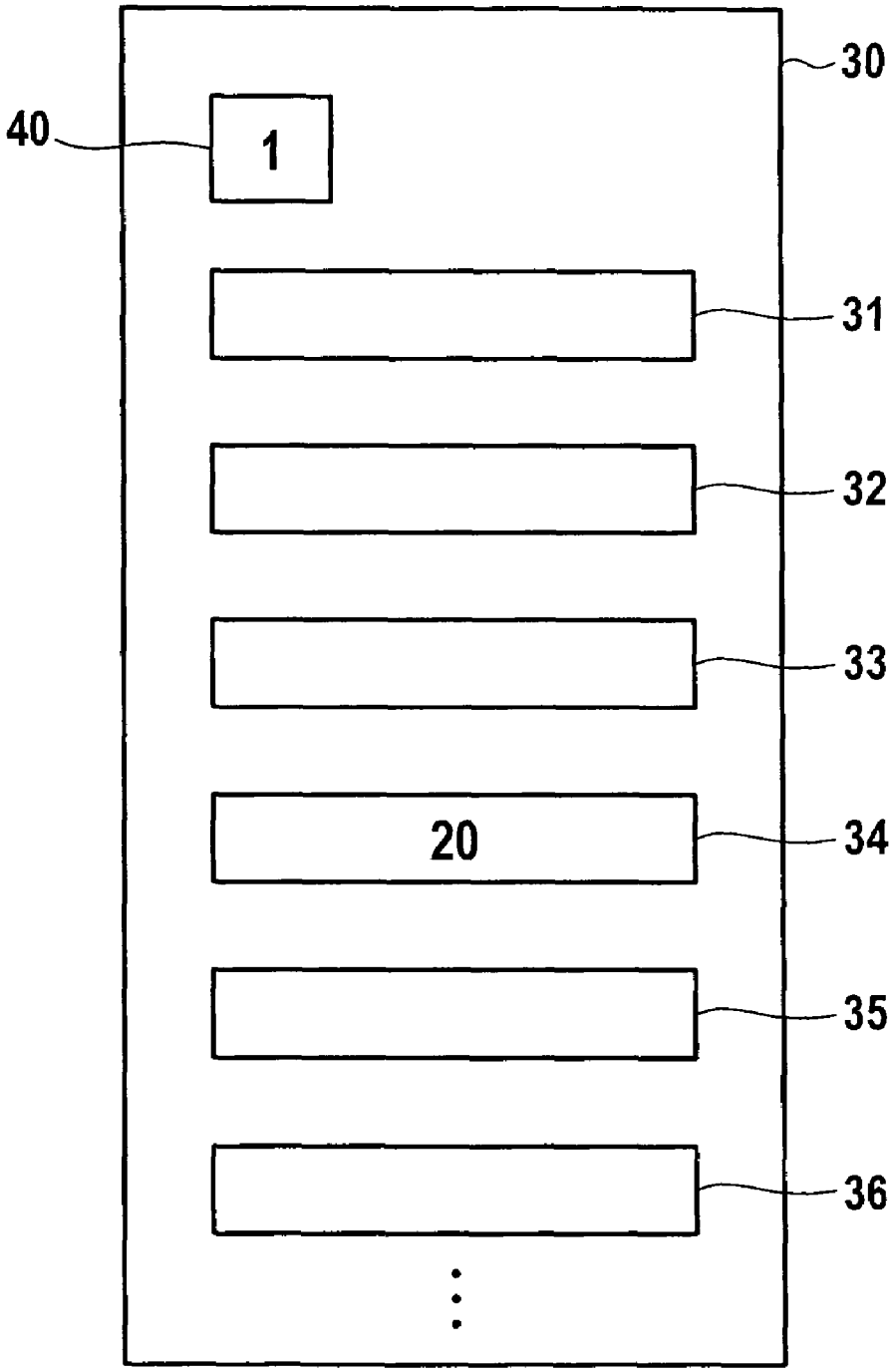
FIG. 2 a schematic illustration of a product data set.

An example of a format for a production data set 30 is shown in FIG. 2. A production data set 30 comprises by way of example a field 31 for storing the cigarette brand, a field 32 for storing the identity of the cigarette production machine 10, a field 33 for storing the production date and time, a field 34 for storing the portion length (in cm in this case) and fields 35, 36, . . . for storing cigarette quality data such as the average weight, the standard deviation of the average weight, etc. The label "1" in the product occupancy identification field 40 indicates that the data set 30 corresponds to a product portion and is not, for example, an empty portion as a result of an interruption of the product mass flow 11.

Preferably, production data sets are written into the storage means 22 only when the product enters the transport section 12. For this purpose, the entry sensor 23 is provided, which sends a corresponding signal to the control means 21 when a product enters the transport section 12 in order to activate the write operation, or in the event of an interruption of the product mass flow entering the transport section 12 to interrupt the write operation by means of a corresponding signal.

In a preferred embodiment the storage means 22 comprises at least one FIFO stack memory 26 in which the product data sets 30*a*, 30*b*, 30*c*, . . . are stored in predetermined sequence in the form of a stack, wherein the product data sets 30*a*, 30*b*, 30*c* . . . first filed on the stack are read out again in the same sequence 30*a*, 30*b*, 30*c*, . . . by taking them out of the stack (FIFO principle).

At the exit end of the transport section 12 an exit sensor 24 is preferably provided in order to detect product emerging from the transport section 12. In the event of product emerging from the transport section 12 the control means 21 can, if required, read out the associated product data set from the storage means 22 and make it available for further use, for example transmit it to the packing machine 13. This occurs when using a FIFO stack memory simply by periodic taking off of a product data set from the stack. Due to the fixed sequence within the stack and the FIFO principle it is ensured that the product data sets 30*a*, 30*b*, 30*c*, . . . are correctly assigned to the product portions 11*a*, 11*b*, 11*c*, 11*d* . . . emerging from the transport section 12 regardless of the length of the transport section 12 in question, in the cigarette store 16 for example. The read-out period is usefully adapted to the exit period of the emerging product portions 11*a*, 11*b*, 11*c*, 11*d*, . . . which is associated with the length of the emerging product portions 11*a*, 11*b*, 11*c*, 11*d*, . . . . When the emerging product portions 11*a*, 11*b*, 11*c*, 11*d*, . . . are of constant length and the transport speed over the entire transport section 12 does not change, the read-out period usefully matches the storage period.

It is not absolutely essential to provide a separate entry sensor 23. The information about product entering the transport section can also be obtained, for example, from a component preceding the transport section 12, in this case from the cigarette production machine 10, if the information identifying a product portion is available there. The same applies to the exit sensor 24, which can be dispensed with when the information identifying a product portion can be obtained, for example, from a component downstream of the transport section, the packing machine 13 in this case. This can be the case, for example, when instead of the length of the product portions in the transport direction the number of individual products per portion is used to define a product portion.

Even in the event of a stoppage of the product mass flow entering the transport section 12 it is not excluded to write product data sets to the storage means 22. These then usefully contain a corresponding label, "0" for example, in a product occupancy identification field 40 in the product data set 30 (see FIG. 2).

Figure 3C:
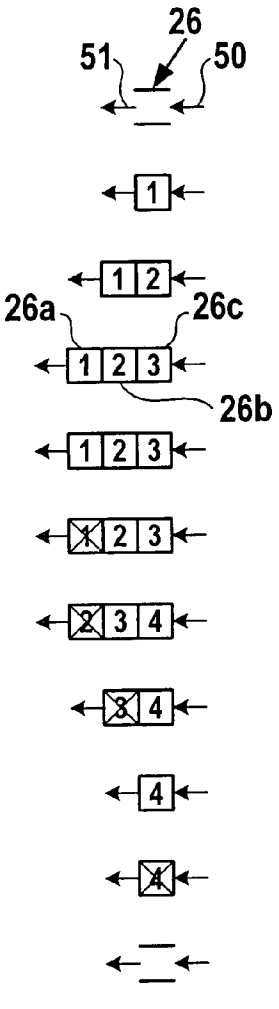
FIG. 3C: a schematic illustration of a FIFO stack memory as data store at the times shown in FIG. 3A.
Figure 3B:
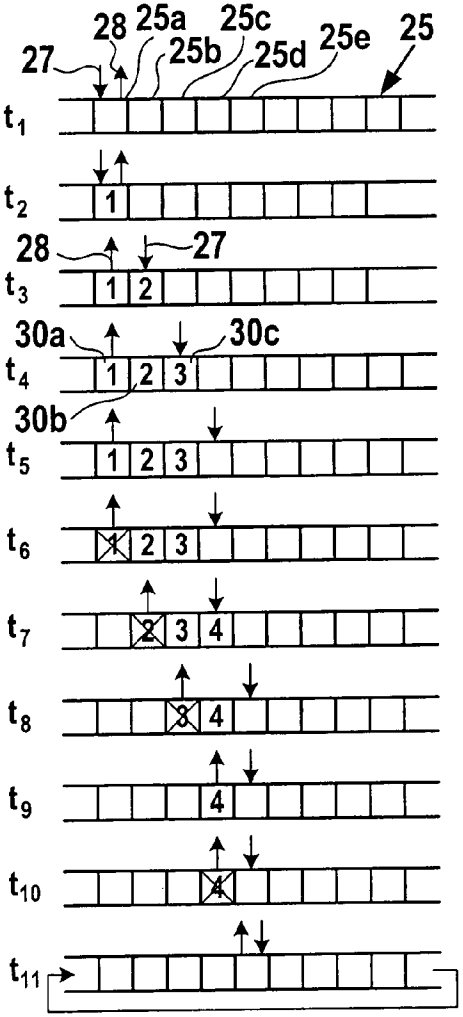
FIG. 3B: a schematic illustration of a ring memory as data store at the times shown in FIG. 3A.
Figure 3A:
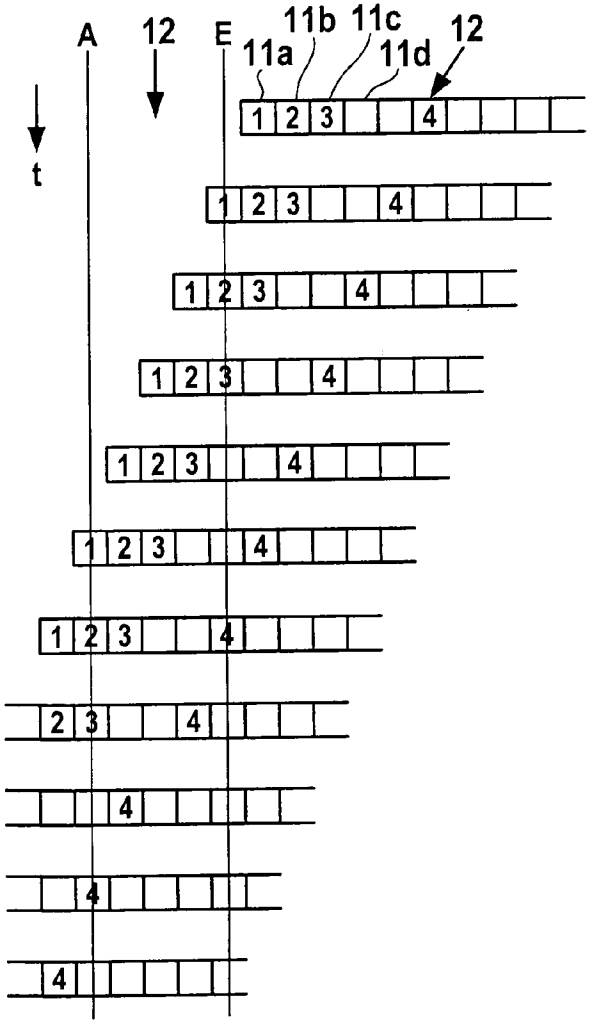
FIG. 3A: a schematic illustration of a cigarette mass flow being transported through the transport section at different times.

FIGS. 3A to 3C serve to explain the storage and reading operation for a ring memory and a FIFO stack memory. In FIG. 3A the passage of a mass flow of cigarettes through the transport section 12 is shown schematically, wherein successive points in time are shown from top to bottom. The vertical line "E" designates entry into and the vertical line "A" exit from the transport section 12. A product portion arranged over the line "E" is detected by the entry sensor 23 and a product portion arranged over the line "A" is detected by the exit sensor 24. In FIG. 3B the corresponding memory state in each case of a ring memory 25 in the storage means 22 for storing the product data sets 30*a*, 30*b*, 30*c*, . . . is illustrated. In FIG. 3C the corresponding memory state in each case of a FIFO stack memory 26 in the storage means 22 for storing the product data sets 30*a*, 30*b*, 30*c*, . . . is alternatively shown. The memory units 25*a*, 25*b*, 25*c*, . . . of the ring memory 25 or the memory units 26*a*, 26*b*, 26*c*, . . . of the FIFO stack memory 26 serve for storing a product data set 30. The ring memory 25 comprises a write pointer 27 and a read pointer 28. The FIFO stack memory 26 comprises a stack input 50 and a stack output 51.

The embodiment shown in FIG. 3B with a ring memory will be described first of all. At time t1, for example at start-up of the transport section 12, the product mass flow 11 has not yet entered the transport section 12. The write pointer 27 and the read pointer 28 are set to the same memory unit 25*a* of the ring memory 25. At time t2 product running into the transport section 12 is detected by the entry sensor 23, a corresponding data set "1" is produced by the control means 21 and written to the memory unit 25*a* identified by the write pointer 27. After this, the write pointer 27 is shifted by one memory unit while the read pointer 28 is kept in position since no product leaving the transport section 12 has been found. At time t3 product running into the transport section 12 is detected by the entry sensor 23, a corresponding data set "2" is generated by the control means 21 and written to the memory unit 25*b* identified by the write pointer 27. After this, the write pointer 27 is again shifted by one memory unit. In analogous fashion at time t4 the product data set corresponding to the product portion "3" is written to the memory unit 25*c* identified by the write pointer 27 and the write pointer 27 is again shifted by one memory unit. At time t5 the entry sensor 23 detects that the product mass flow 11 entering the transport section 12 has been interrupted and therefore stops writing product data sets to the ring memory 25. At time t6 the exit sensor 24 detects that product is leaving the transport section 12. Accordingly, it reads the product data set "1" to which the read pointer 28 refers from the ring memory 25 and which corresponds to the exiting product portion "1". After this, the read pointer 28 is shifted by one memory unit. At time t7 the product data set "4" is written to the memory unit 25*d* identified by the write pointer 27 and the write pointer 27 is shifted by one memory unit and also the product data set "2" is read out of the memory unit 25*b* identified by the read pointer 28 and the read pointer 28 is shifted by one memory unit. At time t8 the product data set "3" is read out of the memory unit 25*c* identified by the read pointer 28 and the read pointer 28 is shifted by one memory unit. At time t9 the exit sensor 24 detects that the product mass flow coming out of the transport section 12 has been interrupted and accordingly stops reading product data sets out of the ring memory 25. At time t10 the exit sensor 24 detects that product is coming out of the transport section 12. Accordingly, the product data set "4" is read out of the memory unit 25*d* identified by the read pointer 28 and the read pointer 28 is shifted by one memory unit. At time t11 the transport section 12 is empty and the ring memory 25 is in a state as at time t1. Since in this embodiment the write and read pointers 27, 28 are shifted along the memory units the memory is constructed as a ring memory 25 so that after a certain end memory unit the write and read pointers 27, 28 are shifted to a start memory unit (see time t11).

In an embodiment having a FIFO stack memory 26 as shown in FIG. 3C the stack memory 26 at time t1 is empty. The stack memory 26 has a stack input 50 and a stack output 51. At time t2 product running into the transport section 12 is detected by the entry sensor 23, a corresponding data set "1" is generated by the control means 21 and placed on the stack, i.e. written by the stack input 50 to the stack memory 26. At time t3 product running into the transport section 12 is detected by the entry sensor 23, a corresponding product data set "2" is generated by the control means 21 and written to the stack memory 26. In analogous manner at time t4 the product data set "3" corresponding to the product portion "3" is written to the stack memory 26. At time t5 the entry sensor 23 detects that the product mass flow 11 entering the transport section 12 has been interrupted and accordingly stops writing product data sets to the stack memory 26. At time t6 the exit sensor 24 detects that product is leaving the transport section 12. Accordingly, it takes the product data set "1" from the stack, i.e. it reads out the product data set "1" from the stack output 51 of the stack memory 26. At time t7 the product data set "4" is written to the stack memory 26 and the product data set "2" is read out of the stack memory 26. At time t8 the product data set the product data set "3" is read out of the stack memory 26. At time t9 the exit sensor 24 detects that the product mass flow 11 coming out of the transport section 12 has been interrupted and accordingly stops reading product data sets out of the stack memory 26. At time t10 the exit sensor 24 detects that product is coming out of the transport section 12. Accordingly, the product data set "4" is read out of the stack memory 26. At time t11 the transport section 12 is empty and, therefore, so is the stack memory 26.

To each transport apparatus 14-17 in the transport section 12 a respective data subset memory can be assigned, in particular a ring memory 25 each with write and read pointers 27, 28 or a FIFO (or possibly a FILO) stack memory 26. This allows handover of product data sets from one subset memory to a following subset memory on transfer of the corresponding product portions from one transport apparatus to the next transport apparatus. In particular on handover the product data sets can usefully be altered. This can be advantageous in particular when different conveying speeds occur in the transport section 12.

In the example in FIG. 1 it may be assumed that the conveyor 14 moves at 20 cm/s while the conveyor 15 moves at 25 cm/s and the product portions on entering the transport section 12 have a length L of 20 cm. After the transition of the product portions from the conveyor 14 onto the conveyor 15 they become longer and flatter due to the increase in speed; more precisely they have a length of 25 cm determined by the ratio of the transport speeds. If now, for example by means of a handover sensor between the conveyors 14 and 15, it is detected that a certain product portion is coming out of the conveyor 14 the corresponding product data set is read out of the subset memory of the memory means 22 corresponding to the conveyor 14, the length information in field 34 of the product data set is altered in accordance with the ratio of the transport speeds and the amended product data set is written to the subset memory of the following conveyor 15.

It is not absolutely essential, however, in the case of a plurality of transport apparatuses 14-17 or when different transport speeds occur in the transport section 12 that to every transport apparatus or every transport segment a respective data subset memory is assigned. This can be dispensed with when, instead of the length of product portions, a variable which is independent of the transport speed is used for determining the product portions, for example the number of individual products per product portion. A single data memory for the entire transport storage section can then be sufficient.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. Method for tracking product data for a continuous product mass flow in a transport storage section of the tobacco-processing industry comprising:

virtually dividing the continuous product mass flow into a plurality of virtual mass flow sections;

producing a product data set for each virtual mass flow section entering the transport storage section, writing the product data sets into corresponding memory units of a data memory, and reading the product data set from the data memory for each virtual mass flow section emerging from the transport storage section.

2. Product data tracking method according to claim 1, wherein each product data set corresponds approximately to a length of the respective virtual mass flow section in a direction of transport.

3. Product data tracking method according to claim 1, further comprising adjusting a length of the virtual mass flow sections.

4. Product data tracking method according to claim 1, wherein the product data sets have a field for storing a length of the respective virtual mass flow section in a direction of transport.

5. Product data tracking method according to claim 1, wherein the product data sets have a field for storing a product occupancy designator.

6. Product data tracking method according to claim 1, wherein the product data sets are each written into a memory unit identified by a displaceable write pointer.

7. Product data tracking method according to claim 6, wherein after a product data set has been written the write pointer is shifted to a logically adjacent memory unit.

8. Product data tracking method according to claim 6, wherein in the event of an interruption of the product mass flow entering the transport storage section the write pointer is held in position.

9. Product data tracking method according to claim 1, wherein the product data sets are each read from a memory unit identified by a displaceable read pointer.

10. Product data tracking method according to claim 9, wherein after a virtual mass flow section has come out of the transport storage section the read pointer is shifted to a logically adjacent memory unit.

11. Product data tracking method according to claim 9, wherein in the event of an interruption of the product mass flow emerging from the transport storage section the read pointer is held in position.

12. Product data tracking method according to claim 9, wherein on start-up of the transport storage section the write pointer and the read pointer are set to the same memory unit.

13. Product data tracking method according to claim 1, wherein the data memory logically maps the transport storage section.

14. Product data tracking method according to claim 1, wherein the data memory comprises at least one first in first out (FIFO) data memory.

15. Product data tracking method according to claim 14, wherein the first in first out (FIFO) data memory is a ring memory.

16. Product data tracking method according to claim 14, wherein the first in first out (FIFO) data memory is a FIFO stack memory.

17. Product data tracking method according to claim 1, wherein the data memory comprises at least one first in last out (FILO) data memory.

18. System for tracking product data for a continuous product mass flow in a transport storage section of the tobacco-processing industry having a storage means comprising a data memory for storing the product data, a write control means for controlling the writing of product data of the continuous product mass flow entering the transport storage section into the data memory and a read control means for controlling the reading of product data of the continuous product mass flow coming out of the transport storage section from the data memory, wherein the write control means is equipped for generating product data sets which each correspond to a virtual subset comprising at least two products of the continuous product mass flow entering the transport storage section and for writing the product data sets into the data memory.

19. Product data tracking system according to claim 18, further comprising an entry sensor for detecting a product portion running into the transport storage section.

20. Product data tracking system according to claim 18, further comprising an exit sensor for detecting a product portion coming out of the transport storage section.

* * * * *